US005294034A

United States Patent [19]

Svensson

[11] Patent Number: 5,294,034

[45] Date of Patent: Mar. 15, 1994

[54] TICKET DISPENSER

[75] Inventor: Kjell Svensson, Ekerö, Sweden

[73] Assignee: Turn-O-Matic AB, Sundbyberg, Sweden

[21] Appl. No.: 828,938

[22] PCT Filed: Aug. 16, 1990

[86] PCT No.: PCT/SE90/00530

§ 371 Date: Feb. 7, 1992

§ 102(e) Date: Feb. 7, 1992

[87] PCT Pub. No.: WO91/03802

PCT Pub. Date: Mar. 21, 1991

[30] Foreign Application Priority Data

Sep. 1, 1989 [SE] Sweden ..... 8902897

[51] Int. Cl.[5] ..... G07B 5/02

[52] U.S. Cl. ..... 225/106; 225/13; 225/52

[58] Field of Search ..... 225/2, 4, 1, 106, 13, 225/9, 52, 90; 206/39.8, 39.1, 39

[56] References Cited

U.S. PATENT DOCUMENTS

| | | | |
|---|---|---|---|
| 843,579 | 2/1907 | Burr et al. | 225/106 |
| 1,704,044 | 3/1929 | Ingram | 225/106 |
| 3,885,724 | 5/1975 | Ehrlund | 225/77 |
| 4,047,652 | 9/1977 | Ehrlund | 225/90 X |
| 4,244,502 | 1/1981 | Reed | 225/106 X |
| 4,267,949 | 5/1981 | Hemgren | 225/106 |
| 4,384,664 | 5/1983 | Roos | 225/106 |

FOREIGN PATENT DOCUMENTS

| | | | |
|---|---|---|---|
| 0086199 | 4/1987 | European Pat. Off. . | |
| 2366367 | 4/1986 | Fed. Rep. of Germany . | |
| 6065 | of 1912 | United Kingdom | 225/13 |

*Primary Examiner*—Rinaldi I. Rada

*Attorney, Agent, or Firm*—Sixbey, Friedman, Leedom & Ferguson

[57] ABSTRACT

A ticket assembly including a casing and at least one cover part which is pivotally connected to the casing is disclosed. The casing has provided therein a feed path, which functions to guide a strip of mutually connected tickets during its passage through the casing and includes a ticket outfeed aperture and mutually opposing guide surfaces in the proximity of the outfeed aperture. The bottom guide surface of the ticket strip feed path includes a bead which extends across a part of the feed path. The bead terminates short of the feed path so as to leave surfaces which constitute an extension of the feed path. The bead thus coacts with upper guide surface in aiding in the separation of the connected tickets.

13 Claims, 3 Drawing Sheets

TICKET DISPENSER

The present invention relates to a ticket dispensing assembly comprising a ticket feeder and a flexible strip of tickets in roll form. The ticket feeder functions to enable tickets to be torn individually from the ticket strip and comprises a casing in which the ticket roll is housed, at least one cover part which is connected pivotally to the casing, and a guide path which is operative to guide a length of continuous strip of tickets taken from the ticket roll. The free end of the continuous strip projects through an outfeed opening in the ticket feeder and serves as a fingergrip by means of which the strip can be pulled from the roll. Means are also provided which, as the free end of the strip is pulled, function to mutually separate parts of strip material which are located between two mutually adjacent tickets and which hold said tickets together. The continuous strip has punched at regular intervals therealong parting lines which define a plurality of tongue-shaped flaps and "flap apertures" and those material parts which hold two mutually adjacent tickets together are located at the ends of respective parting lines and extend approximately transversely to the longitudinal axis of the strip.

An assembly comprising a ticket feeder and a continuous ticket strip of this kind, for instance queue tickets, is known from each of U.S. Pat. Nos. 4,047,652 and 3,885,724. The ticket roll used with these known assemblies comprises a flexible, continuous ticket strip in which respective tickets have punched therein penetrating tongue-shaped flaps which when a ticket located in the outfeed aperture is pulled manually, are brought into contact with guide means, through the medium of a feed path. The guide means functions to guide a tongue-shaped flap in one direction and the remainder of the strip in another direction. In order that an individual ticket can be torn from the strip, it is necessary to provide tear edges against which those parts of the freely protruding ticket are connected to the immediately following ticket can be brought into contact, thereby to separate a ticket from the strip. One drawback with this known assembly is that the continuous ticket strip used therewith can impair the function of the ticket feeder. For instance, the known ticket strip has through "punched" flaps. These flaps are liable to project from the plane of the remainder of the strip, to a greater or lesser extent, and will often fold or buckle before arriving at the outfeed opening of the ticket feeder. When the free end of the ticket strip is torn-off, the following folded flap tends to fasten or jam inside the feeder, making it impossible tear further tickets from the roll until the fault has been remedied, which is irritating to waiting customers.

Furthermore, it is also surprisingly found that with the known ticket feeder, the active tear edges, which are often made of a plastic material, are subjected to considerable wear, which negates the ticket-holding effect otherwise afforded by the feeder. As a result, a pull on the free, exposed end of a ticket strip will result in a continuous strip of tickets being fed through the outfeed aperture and the feeder is unable to separate an individual ticket from the strip.

A further drawback is that the known feeder is only able to accommodate rolls of at most one thousand tickets.

Attempts have been made to increase the dimensions of the known ticket feeder, so that ticket rolls which contain a far larger number of individual ticket can be used, although these attempts have been without success.

Consequently, it is primary object of the present invention to provide an improved assembly which comprises a ticket feeder and a continuous ticket strip of aforedescribed kind and in which the outfeed of a continuous ticket strip and the separation of individual tickets from said strip can take place continually in the absence of any disturbance of the aforesaid kind.

Another object of the invention is to provide an improved assembly in which the ticket feeder is able to readily accommodate a ticket roll that contains up to five thousand tickets. The aforesaid objects are achieved with an assembly of the kind described in the introduction having the characterising features set forth in the following main claim.

So that the invention will be more readily understood and further features thereof made apparent, a preferred embodiment of the invention will now be described with reference to the accompanying drawings, in which: FIG. 1 is a side view of an improved ticket feeder operative to deliver individual tickets from a flexible strip of tickets wound in the form of a roll;

Figure 6:
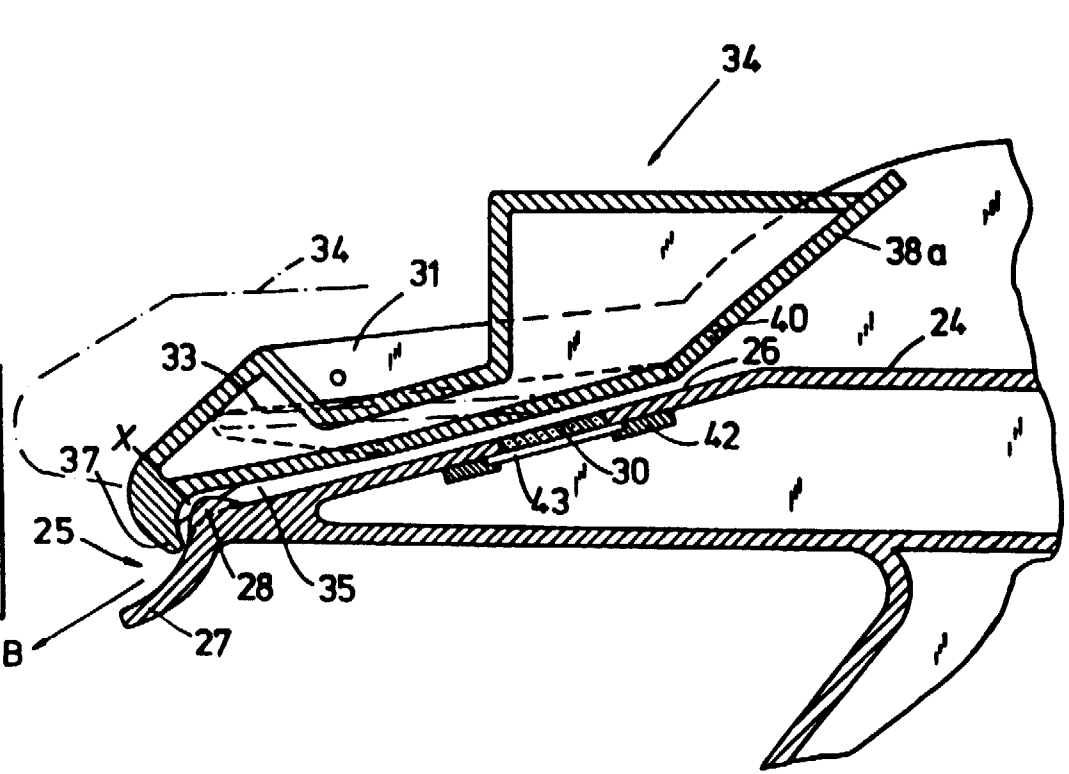
Figure 5:
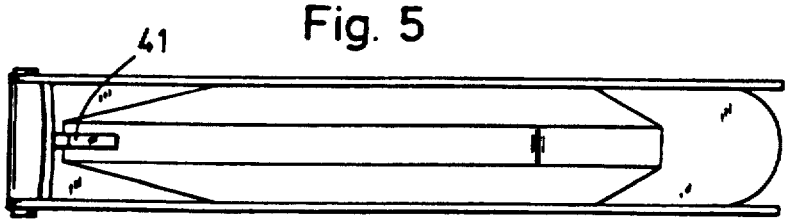
FIG. 5 is view from beneath of one of the pivotal cover parts of the ticket feeder.
Figure 5A:
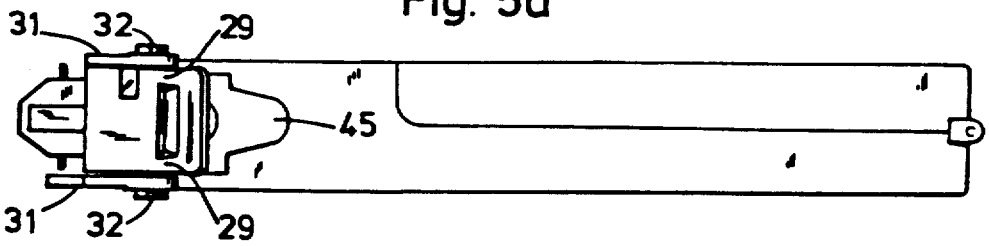
Figure 7:
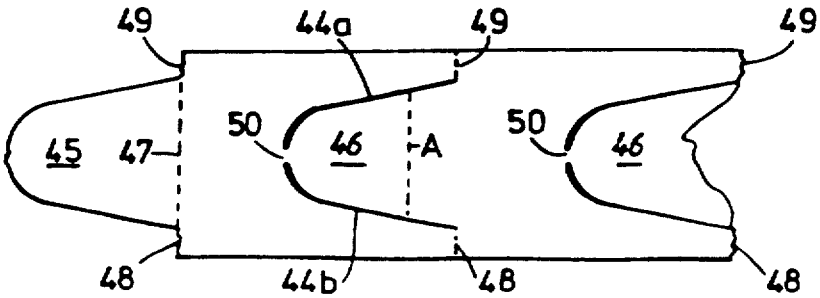

FIG. 5*a* is a front view which includes part of the ticket-strip outfeed part of the ticket feeder;

FIG. 6 is a central sectional view on a larger scale of the outfeed part of said feeder with the displaceable slide shown in an active and in a passive position; and FIG. 7 illustrates a roll of mutually connected tickets intended for use in the ticket feeder of the inventive assembly.

Figure 1:
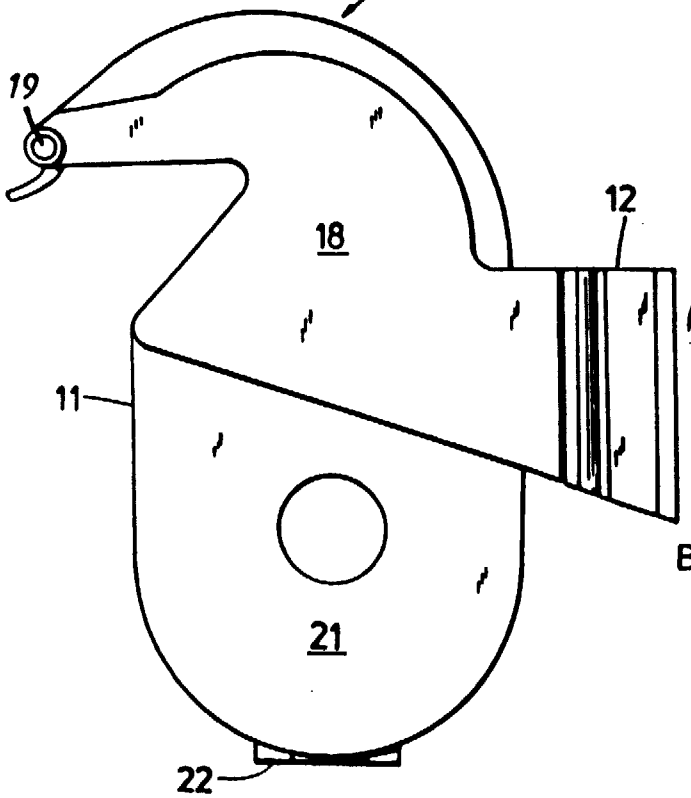

Shown in FIG. 1 is a ticket feeder 10 which accommodates in roll form a flexible and continuous strip of tickets and which functions to separate the tickets one from the other when the strip is pulled manually. The ticket feeder includes a casing 11 and an attachment part 12 which is connected firmly to the casing and by means of which the ticket feeder can be removeably attached to an appropriate wall attachment (not shown).

Figure 2:
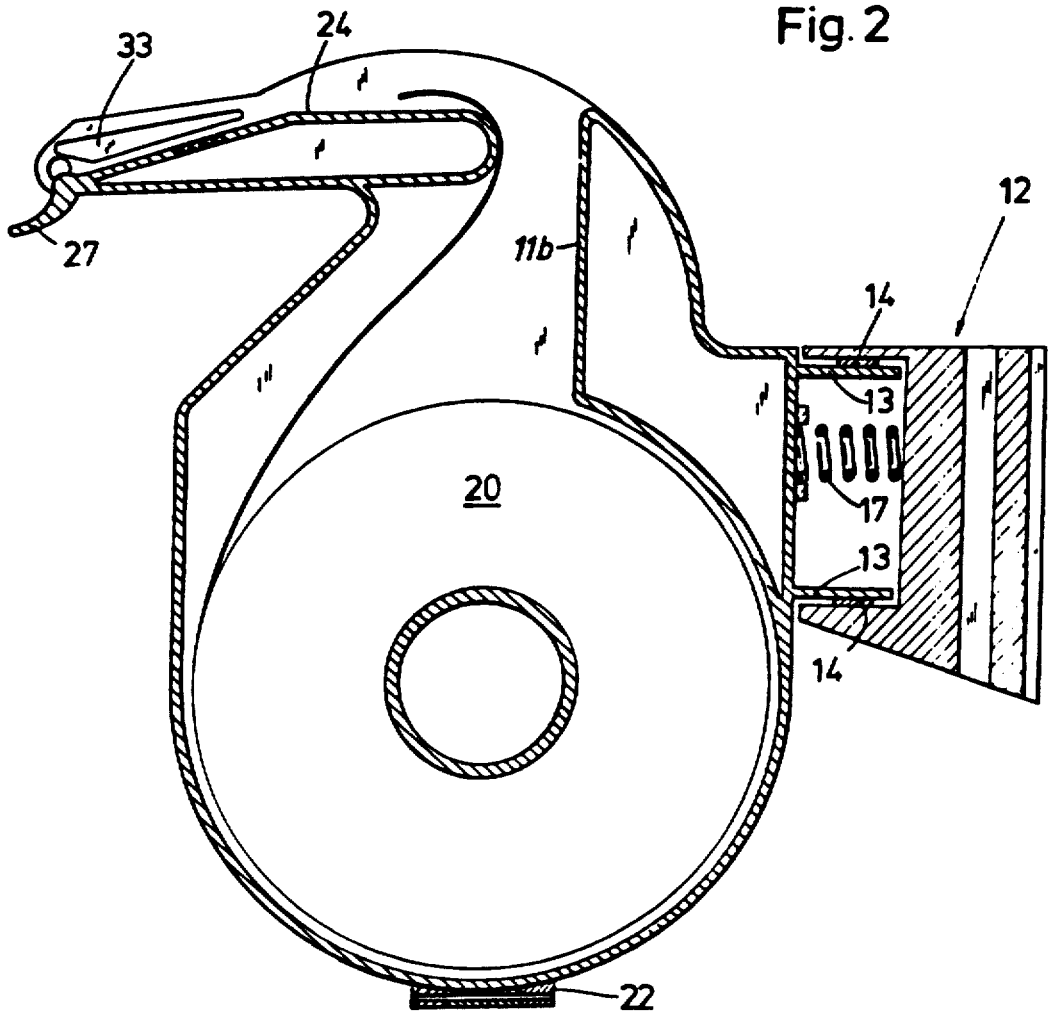
FIG. 2 is a side view of the inventive ticket feeder, partly in section.
Figure 3:
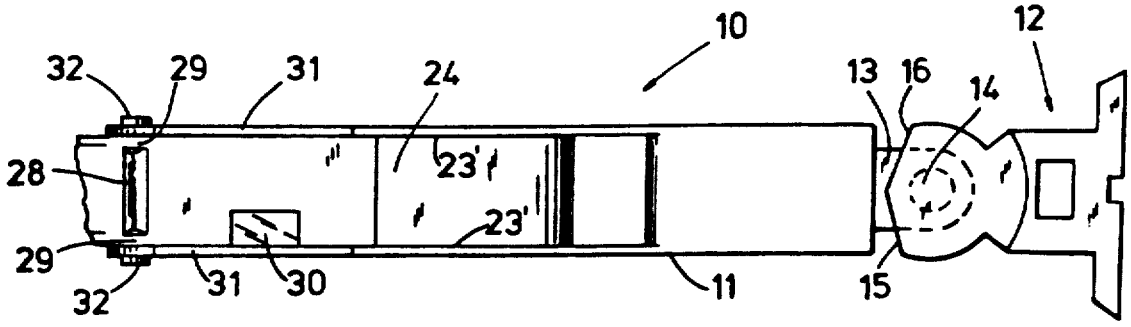
FIG. 3 is a view of the ticket feeder of FIG. 2 from above, but with the slide omitted.

The attachment part 12, which is shown partly in section in FIG. 2 and from above in FIG. 3, is detachably connected to vertically spaced and rearwardly projecting lugs 13, each of which has a pivot pin 14. The ticket feeder 10 can therewith pivot on the pin 14 and the attachment part 12 has vertical surfaces 15, 16 which form abutments operative to limit the extent of said pivotal movement. A relatively stiff spring 17 mounted horizontally within the attachment part 12 functions to return the ticket feeder 10 to the position shown in FIG. 3, in which the feeder 10 and the attachment part 12 lie essentially in one and the same horizontal plane, subsequent to pivoting said ticket feeder.

In the case of the illustrated embodiment, the casing 11 of the ticket feeder 10 comprises a first, upper cover part 18 which is pivotally mounted on a pivot connection 19 described in more detail herebelow. The purpose of the upwardly pivotable cover part 18 is to enable the upper part of the ticket feeder 10 to be exposed so that a ticket roll 20 (FIG. 1) can be introduced into the casing 11, said roll 20 normally comprising 4000–5000 tickets in continuous strip form wound on a bobbin, such as to form said ticket roll.

The reference numeral 11*b* in FIG. 2 identifies an internal limiting wall which is positioned so that if the ticket roll should begin to rotate when the free flap on the continuous ticket strip is pulled, the continuous strip would also unwind from the roll. This unwinding of the strip from the roll is limited and controlled by the wall part 11*b* in a manner such that any lengths of strip that might unwind from the roll will take an S-shape, which would not disturb normal use of the assembly.

For practical reasons, the improved ticket feeder 10 is provided with a second, lower cover part 21 on the same side of the casing as the first cover part 18. This second cover part 21 can be swung downwards about a lower hinge means 22. When the upper cover part 18 is swung upwards and the lower cover part 21 is swung downwards, the whole of one side of the casing 11 will be opened, so that a new ticket roll 20 can be inserted into the ticket feeder, with the bobbin on which the ticket strip is wound resting on flanges 23′ located on mutually opposite casing sides inwardly of the openings, whereby the side edges of the ticket roll 20 will be slightly spaced from the side walls of the casing 11. The other, mutually opposing sides of the casing 11, on the other hand, form an integral part of the casing. Arranged at the top of the casing 11 of the illustrated ticket feeder, and to the left in FIGS. 1 and 2, is a ticket-strip outfeed part, which will now be described.

In the ticket-outfeed region of the ticket feeder, the undivided side of the casing 11 has an elongated ticket path which extends substantially in the direction in which the strip is pulled and the end of which located nearest the roll 20 is curved or gently rounded. The center of the roll 20 preferably lies in the same, or approximately the same plane as the free end of the ticket feed path. The ticket-feed path presents a horizontal, first smooth feed surface 24 which merges with a second feed surface 26 which slopes downwardly towards the outfeed aperture 25 and which is terminated with a first lip 27, said lip being slightly curved in the case of the illustrated embodiment. The sloping surface 26 of the feed path is located essentially in the extension of an optimum ticket-strip pulling direction, and the actual outfeed aperture 25 is located on a lower plane than the lowest point of the sloping feed surface 26, the horizontal, upper surface of the lip 27 forming a support for a part of the flap on the free end or outermost end of the ticket strip. Provided on that part of the path surface 26 located adjacent the lip 27 is a bead 28 which extends across the guide surface 26. The bead 28 resembles the end of a ski-jump construction, i.e. the bead 28 extends slightly upwards at its junction with the guide surface 26 and then drops almost vertically downwards to join the lip 27. The width extension of the bead 28 corresponds approximately to the width A (FIG. 7) of a ticket. Extending on respective sides of the bead 28 are surfaces 29 which lie in substantially the same plane as the bottom surface 26 of the feed path and which merge with the lip 27. The bottom guide surface 24, 26 of the feed path has a width which is at least equal to the largest width of the ticket strip. The downwardly sloping surface 26 of the feed path is provided along one edge region thereof with a transparent window 30, the function of which is described herebelow (FIG. 3).

The aforedescribed outfeed part of the ticket feeder constitutes means for guiding and feeding the continuous ticket strip taken off the roll 20.

The ticket feed path 24, 26 is surrounded in its longitudinal direction by mutually opposing wall parts 31, of which one is removably attached. In the region of the ticket outfeed aperture 25, respective wall parts 31 are provided with an outwardly extending pin 32 (e.g. FIG. 3) which forms the aforesaid pivot attachment 19 for the upper cover part 18. Each of said wall parts 31 is also provided with a groove 33 which extends in the longitudinal direction of the feed path and widens towards the outfeed aperture 25. The grooves 33 are spaced from the upper edge surface of respective walls 31 and function as guide means for the sides of an elongated slide 34 which is mounted for limited movement in the longitudinal direction of the ticket strip.

The under surface 35 of the slide 34 functions as second guide means for the ticket strip, said strip being intended to be fed between the mutually opposing guide surfaces 26 and 35, these surfaces together forming the feed path. The bottom guide surface 35 of the slide 34 merges with a downwardly and rearwardly extending second lip 37 in the region of the ticket outfeed aperture. The end or tip of the lip 37 is rounded and is localised at a small distance from the upwardly facing surface of the outfeed or guide lip 27 on the casing 11, such as to form a slot through which the ticket strip is fed. The bottom surface of the slide 34, which forms the top guide surface 35 of the feed path, is also configured so that feed path widens in a direction towards the outfeed 25 of the ticket feeder to form a larger gap 36, although solely within the approximate region of the bead 28 on the guide surface 26. The aforementioned edge-margin surfaces 29 are not included in the gap widening. As will be seen from FIGS. 4 and 6 for instance, a relatively wide gap is formed between the upper end of the bead 28 and the region in which the guide surface 35 on the slide 34 changes direction and merges with the lip 37, which in the ticket-feeding state of the ticket feeder 10 terminates immediately beneath the side of the bead 28 which faces the outfeed aperture 25.

The upper part of the slide 34 is configured with an upwardly open recess 38 and with a rearward, inclined wall 38*a*.

Figure 4:
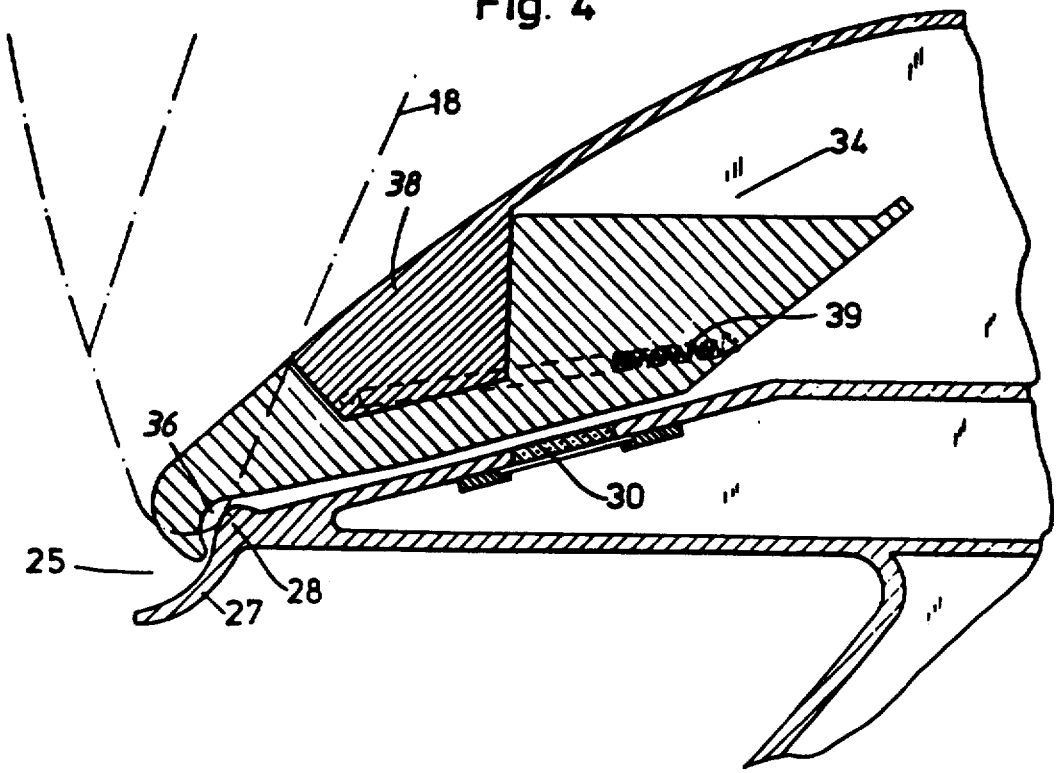
FIG. 4 is a sectional view of the outfeed part of the inventive ticket feeder.

As illustrated in FIG. 4, the ticket feeder 10 includes a pull spring 39 which is attached at one end to a pin 40 in the slide 34 and at the other end to a pin in the wall part 31 located on the same side. A corresponding arrangement is found on the opposite side.

FIG. 5 is a view of the inside of the cover part 18. As shown in the Figure, the cover part includes a member 41 which is complementary in shape to the shape of the recess 38 in the slide 34. Consequently, when a raised cover part (FIG. 4) is lowered, the member 41 will engage the recess 38 and force the slide 34 to move rearwards against the action of the spring 39, to the position shown in FIG. 4. When the cover part 18 is again raised, the slide 34 is moved forwards by the spring 39 to a passive position (FIG. 6) in which, for instance, a new ticket roll can be inserted into the feeder (after lowering the cover part 22) and brought between and into coaction with the guide surfaces 26 and 35 of the feed path. The slide 34 can be removed, by dismantling the removable wall part 31.

Mounted on the underside of the bottom guide surface 26 of the ticket feed path are mutually spaced attachment parts 42 between which a detector device 43 is attached. The detector device 43 is positioned beneath the transparent part 30 in the bottom ticket guide surface 26 and can, in one embodiment, comprises a circuit card comprising an IR diode and a reciever. An electrical conductor (not shown) connects the detector device with a microprocessor provided with an internal and/or external display which informs personnel of, for instance, the number of people queuing for service, thereby enabling additional service personnel to be called upon if necessary. The display can also be made to show the expected waiting time. Other internal and/or external information functions are possible, of course.

Each individual ticket in the continuous ticket strip has a colour marking provided on its undersurface and on one edge margin thereof, this colour marking being readable by the detector. Furthermore, each fifth ticket, for instance, may be provided with a colour marking which differs from the colour marking of the four immediately preceding or the four immediately following markings. The arrangement may be such as to detect the first mentioned colour marking and to send a corresponding signal, for instance, to a counter, so as to provide internal information of the number of customers served and information concerning the number of queuing customers, so that additional service personnel can be called upon when necessary. Such a detection arrangement can also function to indicate to a customer the expected waiting time before he/she is attended to. Other internal/external information can also be given, depending upon the sophistication of the electronic equipment used. The continuous ticket strip in roll form used in conjunction with the aforedescribed ticket feeder is comparable with the ticket strip illustrated described in the aforesaid U.S. Pat. No. 4,047,652.

FIG. 7 illustrates a part of the continuous ticket strip, which is assumed to have been unwound from the ticket roll 20. This continuous strip of tickets has punched therealong in mutually uniform relationship and in a known manner a number of penetrating lines 44*a*, 44*b* such as to form tongue-shaped flaps 45 and correspondingly configured flap openings 46. It will be understood that the flaps 45 and the flap openings 46 can be given a configuration different to that shown, depending, among other things, on the width of the ticket strip. Distinct from the ticket strip according to U.S. Pat. No. 4,047,652, none of the inventive flaps 45 is fully formed, since the center of the ultimate flap is connected with the ultimate flap opening 46 by a small bridge 50, as shown in FIG. 7.

As will be understood, when separated from the strip each individual ticket will present at its forward end a tongue-shaped flap 45, which may have any desired configuration, whereas the rear end of the ticket will present a recess corresponding to and accommodating the flap of the immediately following ticket and thus forming a flap opening 46. In the case of the illustrated emodiment, the tongue-shaped flap of each individual ticket is connected to the continuous strip along the greatest width 47 of the flap 45. This connecting part 47 of each flap extends preferably at right angles to the longitudinal axis of the strip and terminates short of mutually opposite side edges, to form shoulders 48, 49, the width of these shoulders being dependent on the shape of the flap. The broader the flap at its base, the narrower the shoulders 48, 49, and conversely the narrower the flap 45 at its base, the broader the shoulders 48, 49. It is prefered, however, to make these shoulder as narrow as possible, since they form the main strip-parts by means of which the tickets are joined together and since it is these strip parts that are torn from the continuous ticket strip when tearing a ticket therefrom. If desired, these shoulders 48, 49 may be weakened with perforations or some other kind of tear lines. However, this is normally not necessary in the case of a flap of the kind illustrated in the drawing.

When the ticket feeder 10 is in its working state, it is assumed that a ticket roll 20 is mounted in the feeder in the manner illustrated in FIG. 2. The continuous ticket strip indicated in chain lines in FIG. 2—is passed over a rounded end of the feed path surface 24 and into the gap 36, defined between the guide surfaces 26 and 35 of said path. In a functional position, a ticket flap or tongue 45 will protrude beyond the outfeed aperture 25 of the feeder 10, ready to be gripped and pulled. It will be seen that the bridge piece 50 between an ultimate flap 45 and an ultimate flap opening 46 will prevent the flap from jutting from the plane of the strip, thereby enabling the continuous ticket strip to be guided and fed in a smooth path without hinderance of flaps which protrude from the plane of the strip (U.S. Pat. No. 4,047,652).

When the flap 45 is subjected to a pulling force in the direction of the arrow (B FIG. 6), so as to remove the outermost ticket from the continuous ticket strip, two conditions must be fulfilled, namely that the bridge piece 50 is broken in a first phase of the pulling action and that the shoulders 48, 49 are torn from the strip as the pulling action continues. When the ticket flap 45 of a rearwardly located strip part slides over the bead 28, this flap will be located on a higher level than the ticket being torn from the strip. This rearwardly located flap will attempt to continue to move in the direction enforced by the bead 28, while the remainder of the strip tends to continue in the pulling direction (arrow B and FIG. 6). It will be seen that since the flap of the rearwardly lying ticket runs over the bead 28 and the remainder of the ticket extends along the surfaces 29 on opposite sides of the bead 28 in the feed path 26, 35 the tongue-shaped flap of said ticket will travel through a longer path than the remainder of said ticket. Consequently, the pulling force acting on the freely located tongue of the outermost ticket will cause the bridge piece 50 connecting the center of the immediately following ticket with the flap opening of the outermost ticket (see FIG. 7) to rupture and therewith separate the outermost ticket from the immediately following ticket. The forward end of the flap thus released will, in this stage, be located immediately outside the outfeed aperture 25 of the feeder 10, and the flap will strive to move upwards towards the widened space approximately at the point X in FIG. 6 while the rearward part of the flap will be "folded" slightly, which causes a very short interruption in the forward movement of the ticket strip. The pulling action will now be transferred to the shoulders 48, 49, which therewith rapture and release the ticket while leaving the newly exposed tongue-shaped flap of the following ticket in the outfeed aperture so that the flap can be gripped and a further ticket torn from the strip in the aforedescribed manner.

The described ticket feeder operative to deliver individual tickets from a continuous ticket strip affords the important advantage that the free ticket-tongue protruding from the outfeed aperture 25 can, in practise, be pulled forwards at any conceivable angle without impairing the ticket dispensing function of the feeder 10.

What is claimed is:

1. A ticket dispensing assembly comprising a ticket feeder for feeding a continuous, flexible ticket strip in roll form, said ticket feeder including a casing for accommodating the ticket roll, at least one cover part pivotally connected to said casing, a feed path for guiding said continuous ticket strip; an outfeed aperture formed in said casing; vertically spaced top and bottom guide surfaces, between which the continuous strip is guided, defining said feed path; and a separating means for separating strip parts which join two mutually adjacent tickets together wherein the continuous ticket strip has punched therein at regular intervals there along parting lines which form a plurality of tongue-shaped flaps and flap-openings, and the strip parts which join together two mutually adjacent tickets are located at the extremities of a punched parting line and extend approximately, transversely to the longitudinal axis of the ticket strip; said separating means including a first lip positioned externally of said outfeed aperture and merging with said bottom guide surface, an upper surface of said first lip being located on a plane lower than a plane formed by said bottom guide surface with respect to said top guide surface; an elongated bead extending laterally across the feed path, said bead having a length less than a width of the continuous ticket strip; and a second lip formed on said top guide surface, a top thereof being located in the proximity of a side of the bead that faces towards the outfeed aperture; said top guide surface further including a depression adjacent a base of said second lip sherein said depression accommodates at least a portion of said bead.

2. An assembly according to claim 1, wherein the top guide surface of the feed path is formed by the bottom surface of a slide which is mounted for limited movement between sides of the casing.

3. An assembly according to claim 2, wherein mutually opposing sides of said casing include elongated grooves in which the slide is guided.

4. An assembly according to claim 3, further comprising a biasing means for biasing the slide in one direction of movement.

5. An assembly according to claim 3, wherein an upwardly open recess which coacts with a correspondingly shaped element located within the cover part and which is pivotally connected to the casing of the ticket feeder.

6. An assembly according to claim 1, wherein the bottom guide surface of the feed path is rigidly connected to a wall part of the casing and includes a first, straight surface and a sloping second surface connected to a first end of said straight surface; and a second end of said straight surface including gently rounded surfaces for guiding the continuous ticket strip as it leaves the ticket roll.

7. An assembly according to claim 6, wherein said second end of said straight surface lies approximately in a vertical plane including a center of the ticket roll.

8. An assembly according to claim 1, wherein the ticket feeder has an internal wall which extends vertically from an upper part of the casing to approximately a level corresponding to the maximum diameter of a ticket roll.

9. An assembly according to claim 1, wherein the bottom guide surface of said feed path has a transparent part and a detachable detector device mounted beneath said bottom guide surface which is connected by electrical connectors to one or more display devices equipped with a microprocessor or microprocessors.

10. An assembly according to claim 1, wherein one side of the casing of the ticket feeder includes two cover parts which can be pivoted independently of one another and which afford access to the interior of the ticket feeder.

11. An assembly according to claim 1, further comprising flanges mounted internally on sides of the casing wherein said ticket roll is wound on a bobbin which is positioned on said flanges.

12. An assembly according to claim 1, wherein the ticket feeder includes a detachable attachment means for detachable attachment of the ticket feeder to a wall attachment.

13. An assembly according to claim 12, wherein the detachable attachment means is pivotly connected to the ticket feeder to permit limited rotation of the ticket feeder, and a spring is provided for aligning the ticket feeder with the attachment part.

* * * * *